US007043927B2

(12) United States Patent
Burchill et al.

(10) Patent No.: US 7,043,927 B2
(45) Date of Patent: May 16, 2006

(54) TRANSPORT REFRIGERATION SYSTEM

(75) Inventors: Jeffrey John Burchill, Syracuse, NY (US); John Pletl, Clay, NY (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 10/406,658

(22) Filed: Apr. 3, 2003

(65) Prior Publication Data

US 2004/0194498 A1 Oct. 7, 2004

(51) Int. Cl.
*F25B 49/00* (2006.01)

(52) U.S. Cl. ..... 62/126; 62/129

(58) Field of Classification Search ..... 62/126, 62/127, 130, 129, 157, 216, 217, 228.3, 278, 62/298, 228

See application file for complete search history.

(56) References Cited

U.S. PATENT DOCUMENTS

| | | | | |
|---|---|---|---|---|
| 3,736,765 | A * | 6/1973 | O'Dell | 62/127 |
| 3,890,836 | A * | 6/1975 | McKenzie et al. | 73/168 |
| 4,146,085 | A * | 3/1979 | Wills | 165/11.1 |
| 4,426,850 | A * | 1/1984 | Reedy | 62/125 |
| 4,723,703 | A | 2/1988 | Thompson | |
| 4,799,362 | A * | 1/1989 | Chestnut | 62/127 |
| 5,172,560 | A | 12/1992 | Jurewicz et al. | |
| 5,279,609 | A * | 1/1994 | Meckler | 236/49.3 |
| 5,467,245 | A * | 11/1995 | Newbould | 361/170 |
| 5,669,224 | A * | 9/1997 | Lenarduzzi | 62/160 |
| 5,816,059 | A * | 10/1998 | Ficchi et al. | 62/127 |
| 6,138,467 | A * | 10/2000 | Lifson et al. | 62/217 |
| 6,238,188 | B1 * | 5/2001 | Lifson | 417/42 |
| 6,280,781 | B1 * | 8/2001 | Lande | 426/34 |
| 6,318,100 | B1 * | 11/2001 | Brendel et al. | 62/217 |
| 6,321,549 | B1 * | 11/2001 | Reason et al. | 62/223 |
| 6,321,550 | B1 * | 11/2001 | Chopko et al. | 62/228.3 |
| 6,357,241 | B1 * | 3/2002 | Dudley | 62/126 |
| 6,539,734 | B1 * | 4/2003 | Weyna | 62/126 |

FOREIGN PATENT DOCUMENTS

| | | | |
|---|---|---|---|
| EP | 1279907 | A2 | 1/2003 |
| JP | 11044467 | A * | 2/1999 |
| JP | 11142001 | A * | 5/1999 |
| JP | 02000292082 | A * | 10/2000 |

* cited by examiner

*Primary Examiner*—Mohammad M. Ali
(74) *Attorney, Agent, or Firm*—Wall Marjama & Bilinski LLP

(57) ABSTRACT

A transport refrigeration system, the transport refrigeration system including a container defining an enclosed volume and a refrigeration module coupled to the container. The refrigeration module is disposed to regulate the temperature of the enclosed volume and includes a compressor having a discharge port and a suction port, a condenser heat exchanger unit operatively coupled to the discharge port, an evaporator heat exchanger unit operatively coupled to the suction port, a condenser fan disposed proximate to the condenser heat exchanger unit, an evaporator fan disposed proximate to the evaporator heat exchanger unit; and a suction modulation valve coupled to the suction port. The transport refrigeration system further includes a bypass module coupled to the refrigeration module. The bypass module includes: a bypass mode switch having a normal operation position and bypass operation position; and an operational mode switch having a full cool position and fan only position. The transport refrigeration system also includes an electronic controller coupled to the bypass module. When the bypass mode switch is in the normal operation position the electronic controller regulates the operation of the refrigeration module. When the bypass mode switch is in the bypass operation position, the compressor, the condenser fan, the evaporator fan and the suction modulation valve are selectively operated by the position of the operational mode switch.

15 Claims, 5 Drawing Sheets

TRANSPORT REFRIGERATION SYSTEM

BACKGROUND OF THE INVENTION

1. Field of the Invention

The present invention relates to transport refrigeration systems, and more particularly to a bypass switch for transport refrigeration systems.

2. Description of Related Art

A particular difficulty of transporting perishable items is that such items must be maintained within a narrow temperature range to prevent, depending on the items, spoilage or conversely damage from freezing. In order to maintain proper temperatures within a transport cargo space a transport refrigeration unit is used. The transport refrigeration unit is typically under the direction of an electronic controller. The electronic controller ensures that the transport refrigeration unit maintains a certain thermal environment within a transport cargo space. The failure of the electronic controller can cause loss of the desired thermal environment and the subsequent spoilage of the perishable items stored therein. There is a need therefore for a bypass switch that will allow the continued operation of the transport refrigeration unit in the event that the electronic controller fails.

Conventionally, a failed electronic controller may be bypassed and limited operation of the transport refrigeration system restored by exposing the electrical circuitry of the transport refrigeration system and installing electrical jumpers. The installation of the electrical jumpers exposes the person installing the jumpers to electrical shock. Therefore, there is a need to provide a safer mechanism for bypassing the electrical controller.

SUMMARY OF THE INVENTION

One embodiment of the present invention includes a refrigeration unit for regulating the temperature of an enclosed volume. The refrigeration unit includes a refrigeration module. The refrigeration module includes a compressor having a discharge port and a suction port. The refrigeration module further includes a condenser heat exchanger unit operatively coupled to the discharge port. The refrigeration module further includes an evaporator heat exchanger unit operatively coupled to the suction port. The refrigeration module further includes a condenser fan disposed proximate to the condenser heat exchanger unit. The refrigeration module further includes an evaporator fan disposed proximate to the evaporator heat exchanger unit and a suction modulation valve coupled to the suction port. The refrigeration module is disposed to regulate the temperature of the enclosed volume. The refrigeration unit further includes a bypass module coupled to the refrigeration module. The bypass module includes a bypass mode switch and an operational mode switch. The bypass mode switch has a normal operation position and a bypass operation position. The operational mode switch has a full cool position and fan only position. The refrigeration unit further includes an electronic controller coupled to the bypass module. When the bypass mode switch is in the normal operation position the electronic controller regulates the operation of the compressor, the condenser fan, the evaporator fan and the suction modulation valve. When the bypass mode switch is in the bypass operation position, the compressor, the condenser fan, the evaporator fan and the suction modulation valve are selectively operated by the bypass module. This selective operation is controlled by the position of the operational mode switch.

In another embodiment, the present invention includes a refrigeration unit for regulating the temperature of an enclosed volume. The refrigeration unit includes a refrigeration module coupled to the container. The refrigeration module includes a compressor having a discharge port and a suction port. The refrigeration module further includes a condenser heat exchanger unit operatively coupled to the discharge port. The refrigeration module further includes an evaporator heat exchanger unit operatively coupled to the suction port. The refrigeration module further includes a suction modulation valve coupled to the suction port. The refrigeration module is disposed to regulate the temperature of the enclosed volume. The refrigeration unit further includes a bypass module coupled to the refrigeration module. The bypass module includes a bypass mode switch and an operational mode switch. The bypass mode switch has a normal operation position and bypass operation position. The operational mode switch has a full cool position and an evaporator only position. The refrigeration unit further includes an electronic controller coupled to the bypass module. When the bypass mode switch is in the normal operation position the electronic controller regulates the operation of the compressor, the condenser heat exchange unit, the evaporator heat exchanger unit and the suction modulation valve. When the bypass mode switch is in the bypass operation position, the compressor, the condenser heat exchanger unit, the evaporator heat exchanger unit and the suction modulation valve are selectively operated by the bypass module, and the selective operation is controlled by the position of the operational mode switch. A liquid coolant ins circulated through the compressor, the condenser heat exchanger unit, the evaporator heat exchanger unit and the suction modulation valve.

In another embodiment, the present invention includes a transport refrigeration system. The transport refrigeration system includes a container, the container defining an enclosed volume. The transport refrigeration system further includes a refrigeration module coupled to the container. The refrigeration module is disposed to regulate the temperature of the enclosed volume. The refrigeration module includes a compressor having a discharge port and a suction port. The refrigeration module further includes a condenser heat exchanger unit operatively coupled to the discharge port. The refrigeration module further includes an evaporator heat exchanger unit operatively coupled to the suction port. The refrigeration module further includes a condenser fan disposed proximate to the condenser heat exchanger unit. The refrigeration module further includes an evaporator fan disposed proximate to the evaporator heat exchanger unit. The refrigeration module further includes a suction modulation valve coupled to the suction port. The transport refrigeration system further includes a bypass module coupled to the refrigeration module. The bypass module includes a bypass mode switch and an operational mode switch. The bypass mode switch has a normal operation position and bypass operation position. The operational mode switch has a full cool position and fan only position. The transport refrigeration system further includes an electronic controller coupled to the bypass module. When the bypass mode switch is in the normal operation position the electronic controller regulates the operation of the compressor, the condenser fan, the evaporator fan and the suction modulation valve. When the bypass mode switch is in the bypass operation position, the compressor, the condenser fan, the evaporator fan and the suction modulation valve are selectively operated by the bypass module. The selective operation of the compressor, the condenser fan, the evaporator fan and the suction modulation valve are controlled by the position of the operational mode switch.

In another embodiment, the present invention includes a control module for a refrigeration system. The control module includes an electronic controller for controlling the refrigeration system and a bypass module coupled to the refrigeration system and the electronic controller. The bypass module includes a plurality of switches whereby the electronic controller may be isolated from the refrigeration system while operation of selected components of the refrigeration system is maintained.

DETAILED DESCRIPTION OF THE PREFERRED EMBODIMENTS

Figure 1:
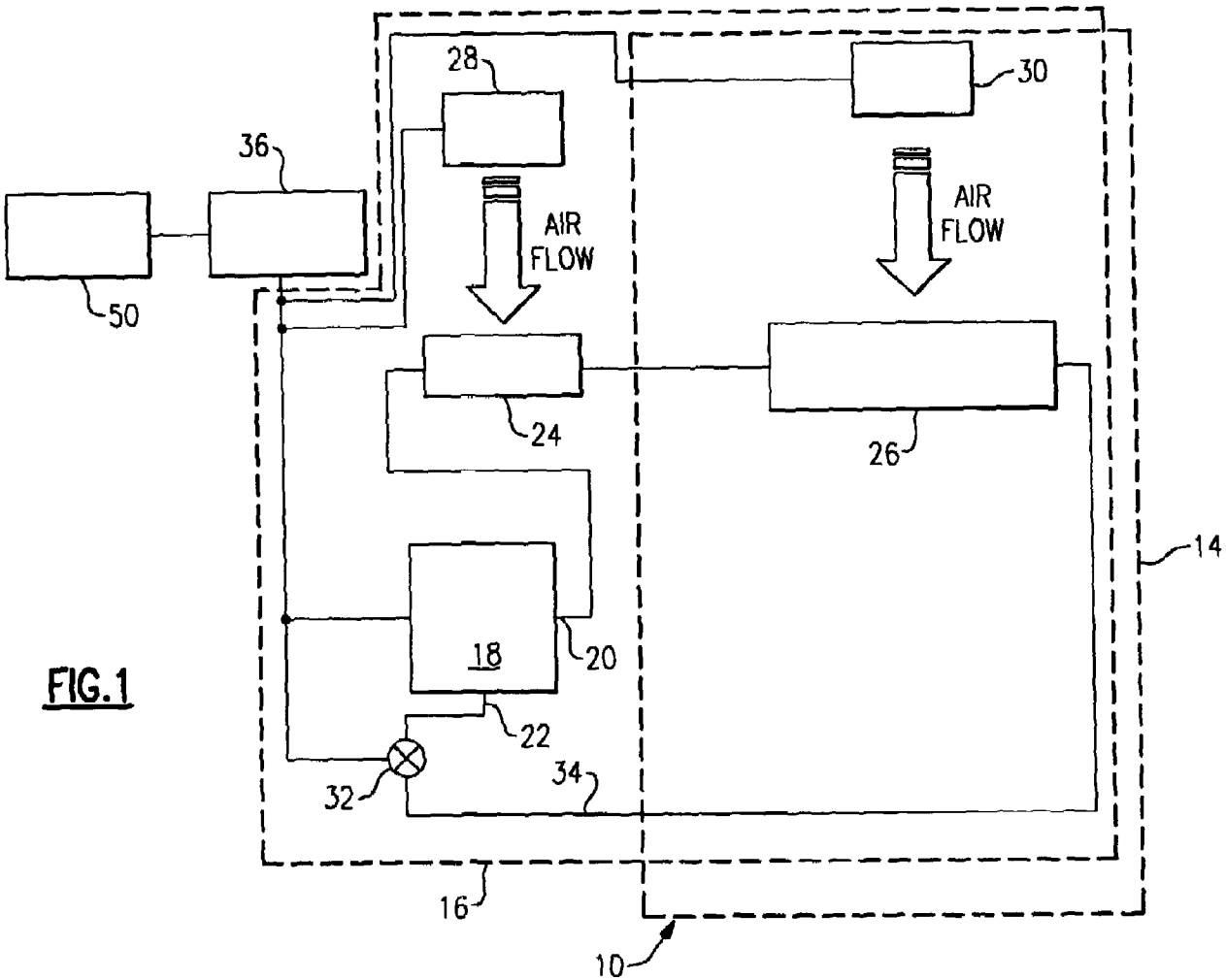
FIG. 1 is a schematic representation of a refrigeration unit embodiment of the present invention.

Reference will now be made in detail to the present preferred embodiments of the invention, examples of which are illustrated in the accompanying drawings. Whenever possible, the same reference numerals will be used throughout the drawings to refer to the same or like parts. An embodiment of the present invention is shown in FIG. 1, and is designated generally throughout by reference numeral 10.

FIG. 1 depicts the present invention embodied as a refrigeration unit 10 for regulating the temperature of an enclosed volume 14. The refrigeration unit 10 includes a refrigeration module 16, a bypass module 36 and an electronic controller 50. The electronic controller 50 is coupled to the bypass module 36 which is in turn coupled to the refrigeration module 16.

The refrigeration module 16 includes a compressor 18, a condenser heat exchanger 24, an evaporator heat exchanger 26, a condenser fan 28, an evaporator fan 30 and a suction modulation valve 32.

The compressor 18 has discharge port 20 and a suction port 22. The compressor 18 operates on three phase electrical power, and operates at a constant speed. The compressor 18 may be a scroll compressor, such as, for example an scroll compressor available from Carrier Corporation of Syracuse, N.Y., USA or any other type of compressor know to those skilled in the art suitable for use in a refrigeration system. The refrigeration unit receives electrical power from, for example a normal commercial power service, a shipboard power generation system or from a diesel generator.

The refrigeration module 16 further includes a suction modulation valve 32. The suction modulation valve 32 is a mass flow control device located in the refrigeration loop 34 between the evaporator heat exchanger unit 26 and the suction port 24 of the compressor 18. The suction modulation valve 32 serves to limit the amount of coolant available to the compressor 18 thereby helping to regulate the amount of cooling provided by the refrigeration module 16. Typically, the suction modulation valve 32 includes a variable position valve(not shown), the position of which is controlled by a electrical stepper motor (not shown).

The refrigeration module 16 further includes a condenser heat exchanger unit 24. The condenser heat exchanger unit 24 is operatively coupled to the discharge port 20 of the compressor 18.

The refrigeration module 16 further includes an evaporator heat exchanger unit 26. The evaporator heat exchanger unit 26 is operatively coupled to the suction port 22 of the compressor 18.

The refrigeration module 16 further includes a condenser fan 28 located to direct an air stream onto the condenser heat exchanger unit 24 thereby allowing heat to be removed from the coolant circulating within the condenser heat exchanger unit 24.

The refrigeration module 16 further includes an evaporator fan 30 located to direct an air stream onto the evaporator heat exchanger unit 26. The evaporator fan 30 is located and ducted so as to circulate the air contained within the enclosed volume 14 of the container 12. The evaporator fan 30 blows a stream of air across the surface of the evaporator heat exchanger unit 26. Heat is thereby removed from the air lowering the temperature of the air circulating within the enclosed volume 14 of the container 12.

The transport refrigeration system 100 further include a bypass module 36 and an electronic controller 50. The electronic controller 50 is coupled to the bypass module 36, while the bypass module 36 is in turn coupled to the refrigeration module 16. Thus, the electrical connections that allow the electronic controller 50 to regulate the temperature of the internal volume 14 of the container 12 are made from the electronic controller 50 to the refrigeration module 16 by way of the bypass module 36.

The electronic controller 50 such as, for example an MicroLink™ 2i controller available from Carrier Corporation of Syracuse, N.Y., USA., is electrically connected to the compressor 18, the condenser fan 28, the evaporator fan 30, and the suction modulation valve 32. The electronic controller 50 is configured to operate the refrigeration module 16 to maintain a predetermined thermal environment within the enclosed volume 14 of the container 12. The electronic controller 50 maintains the predetermined environment by selectively controlling the operation of the compressor 18, the condenser fan 28, the evaporator fan 30, and the suction modulation valve 32. For example, if increased cooling of the enclosed volume 14 is required, the electronic controller 50 provides electrical power to the compressor 16, the condenser fan 28, and the evaporator fan 30. Additionally, the electronic controller 50 adjusts the position of the suction modulation valve 32 to increase the flow of coolant supplied to the compressor 16. If less cooling of the enclosed volume 14 is required then the electronic controller 50 adjust the position of the suction modulation valve 32 to decrease the flow of coolant supplied to the compressor 16.

The bypass module 36 includes a bypass mode switch 38. The bypass mode switch 38 is a manual mechanical switch that has two positions, a normal operation position 40 and bypass operation position 42. The bypass mode switch 44 is typically maintained in the normal operation position 40 and is only moved to the bypass operation position 42 when a failure has occurred with the electronic controller 50 and the electronic controller 50 is no longer capable of controlling the operation of the refrigeration module 16 thereby jeopardizing any perishables stored within the container 12.

When the bypass mode switch 38 is in the normal operation position the electronic controller 50 regulates the operation of the compressor 18, the condenser fan 28, the evaporator fan 30 and the suction modulation valve 32.

When the bypass mode switch 38 is in the bypass operation position 42 the electrical connections between the electronic controller 50 and the refrigeration module 16 are severed, therefore the electronic controller 50 no longer controls the operation of the refrigeration module 16. Placing the bypass mode switch 38 in the bypass operation position 42 passes control of the refrigeration module 16 from the electronic controller 50 to the bypass module. The compressor 18, the condenser fan 28, the evaporator fan 30 and the suction modulation valve 32 are selectively operated by the bypass module 36 in accordance with the position of the bypass module's 36 operational mode switch 44.

The operational mode switch 44 is a multiple position switch that includes a full cool position 46 and evaporator fan only position 48. The selective operation of the compressor 18, the condenser fan 28, the evaporator fan 30 and the suction modulation valve 32 is controlled by the position of the operational mode switch 44. When the operational mode switch 44 is in the full cool position 46 the suction modulation valve 32 is opened to its maximum setting, electrical power is supplied to the compressor 18, the evaporator fan 28 and to the condenser fan 30. The compressor 18, the evaporator fan 28 and the condenser fan 30 are operated to provide maximum cooling to the enclosed volume 14. Preferably, the electrical power supplied to the evaporator fan 28 and the condenser fan 30 is sufficient to allow the evaporator fan 28 and the condenser fans 30 to operate at their respective maximum airflow settings.

In an alternative embodiment, the refrigeration unit 10 also includes an emergency defrost switch and a heater.

Figure 2:
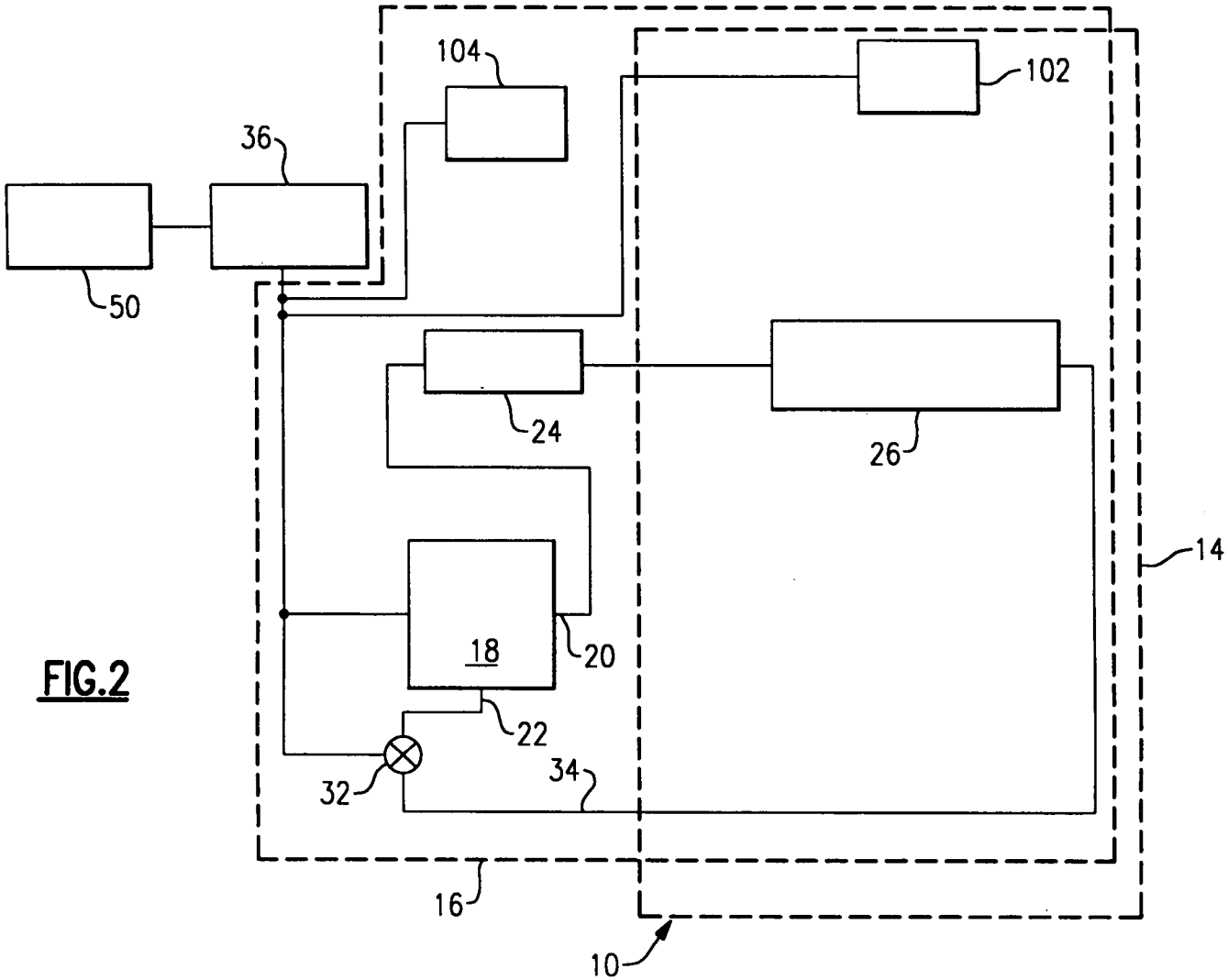
FIG. 2 is a schematic representation of a refrigeration unit embodiment of the present invention.

In an alternative embodiment of the refrigeration unit 10 of the present invention shown in FIG. 2, the condenser fan 30 is replaced by a first circulating fluid heat exchanger 102 and the evaporator fan 28 is replaced by a second circulating fluid heat exchanger 104. The first circulating fluid heat exchanger 102 is thermally coupled to the condenser heat exchanger unit 24 and removes heat from the coolant and transfers the heat to a second circulating fluid. The second circulating fluid heat exchanger 104 is thermally coupled to the evaporator heat exchanger unit 26 and transfers heat from a third circulating fluid within the second circulating fluid heat exchanger 104 to the coolant within the evaporator heat exchanger unit 26.

Figure 3:
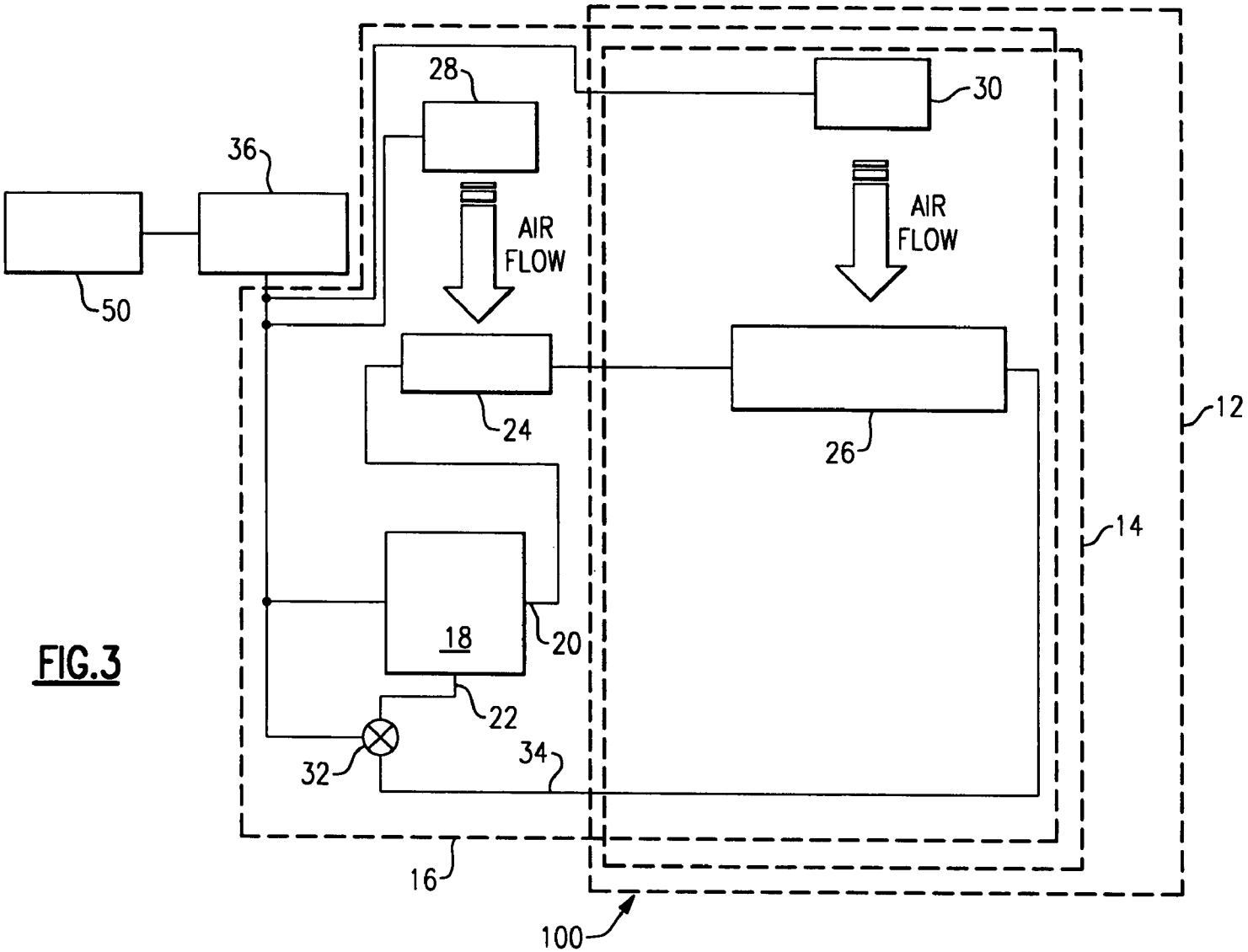
FIG. 3 is a schematic representation of the transportation refrigeration system of the present invention.
Figure 4:
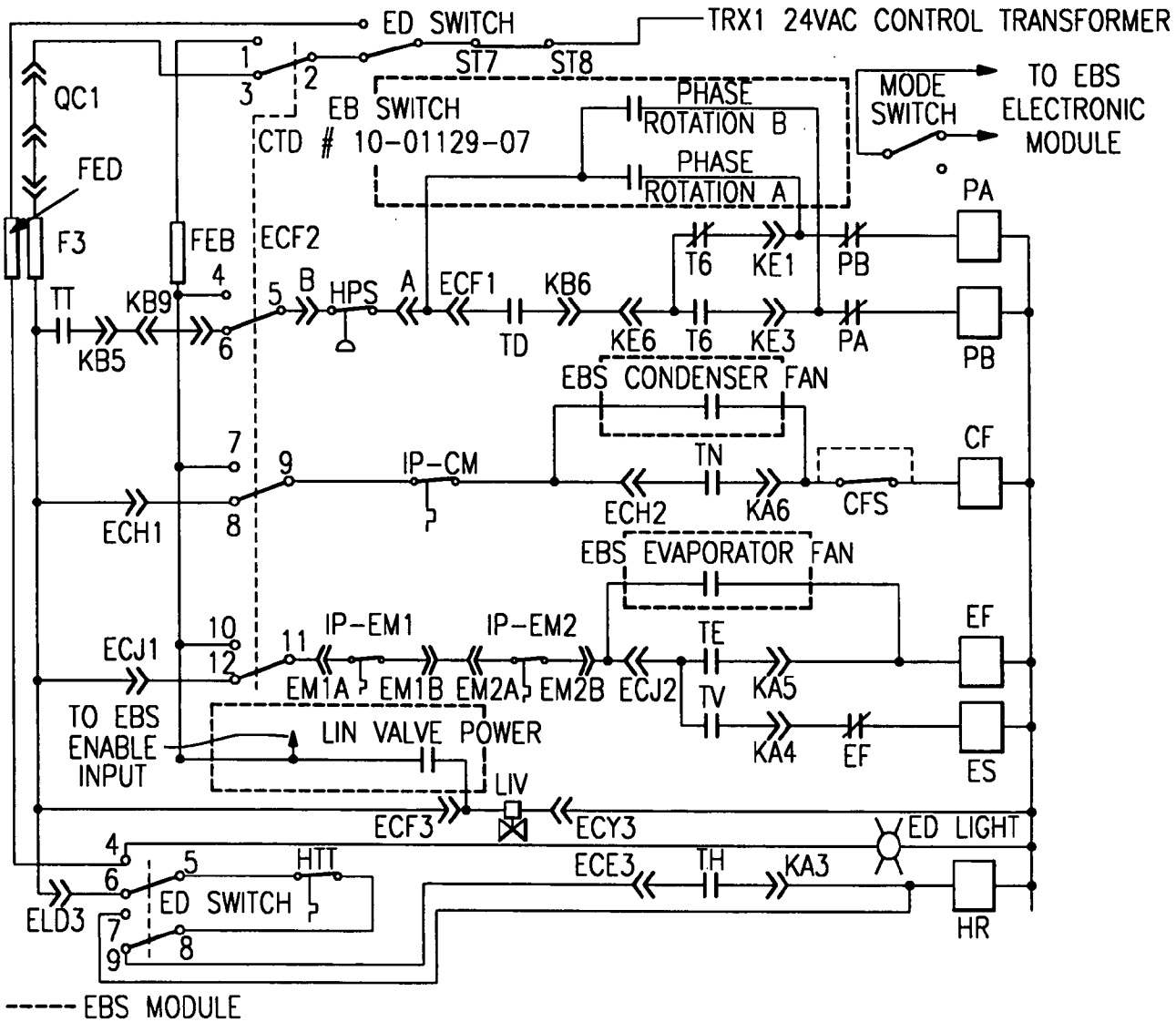
FIG. 4 is an electrical schematic of the bypass module of the present invention and FIG. 5 is a functional schematic diagram of a bypass module according to the invention.
Figure 5:
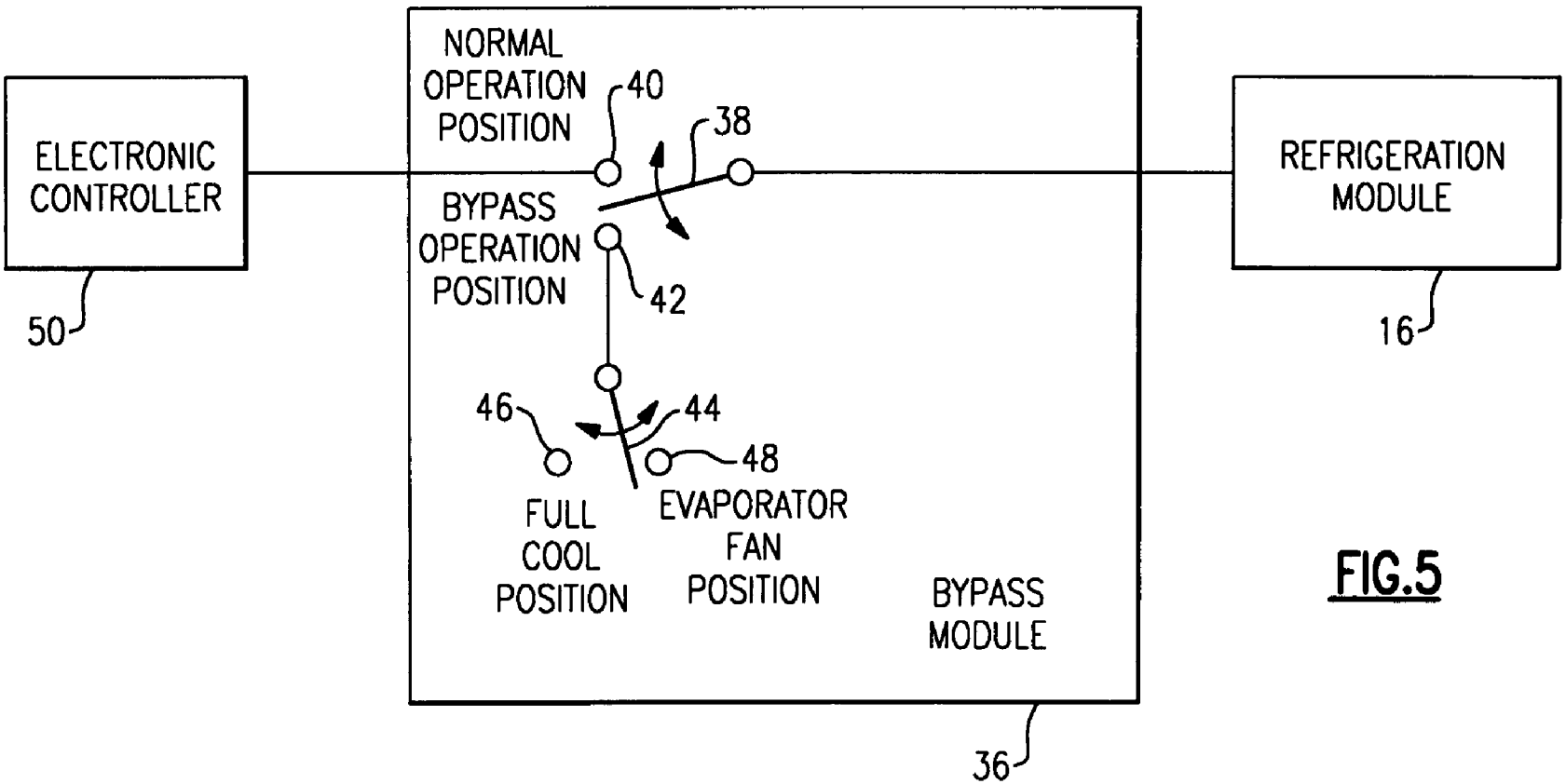

In an alternative embodiment of the present invention depicted in FIG. 3, the present invention is embodied as a transport refrigeration system 100 of the present invention includes a container 12, such as, for example a trailer, a intermodal container, a railcar and the like, used for the transportation or storage of goods requiring a temperature controlled environment, such as, for example foodstuffs and medicines. The container 12 includes an enclosed volume 14 for the storage of said goods. The enclosed volume 14 may be an enclosed space that isolates the interior atmosphere from the outside of the container 12.

The transport refrigeration system 100 also includes a refrigeration module 16 coupled to the container 12. The refrigeration module 16 is located so as to maintain the temperature of the enclosed volume 14 of the container 12 within a predefined temperature range. The refrigeration module 16 includes a compressor 18 having a discharge port 20 and a suction port 22. The compressor is powered by three phase electrical power, and operates at a constant speed. The compressor 18 may be a scroll compressor, such as, for example an scroll compressor available from Carrier Corporation of Syracuse, N.Y., USA. The refrigeration unit requires electrical power from, for example a normal commercial power service, a shipboard power generation system or from a diesel generator.

The refrigeration module 16 further includes a condenser heat exchanger unit 24. The condenser heat exchanger unit 24 is operatively coupled to the discharge port 20 of the compressor 18.

The refrigeration module 16 further includes an evaporator heat exchanger unit 26. The evaporator heat exchanger unit 26 is operatively coupled to the suction port 22 of the compressor 18.

The refrigeration module 16 further includes a condenser fan 28 located to direct an air stream onto the condenser heat exchanger unit 24 thereby allowing heat to be removed from the coolant circulating within the condenser heat exchanger unit 24.

The refrigeration module 16 further includes an evaporator fan 30 located to direct an air stream onto the evaporator heat exchanger unit 26. The evaporator fan 30 is located and ducted so as to circulate the air contained within the enclosed volume 14 of the container 12. The evaporator fan 30 blows a stream of air across the surface of the evaporator heat exchanger unit 26. Heat is thereby removed from the air lowering the temperature of the air circulating within the enclosed volume 14 of the container 12.

The refrigeration module 16 further includes a suction modulation valve 32. The suction modulation valve 32 is a mass flow control device located in the refrigeration loop 34 between the evaporator heat exchanger unit 26 and the suction port 24 of the compressor 18. The suction modulation valve 32 serves to limit the amount of coolant available to the compressor 18 thereby helping to regulate the amount of cooling provided by the refrigeration module 16. Typically, the suction modulation valve 32 includes a variable position valve(not shown), the position of which is controlled by a electrical stepper motor (not shown).

The transport refrigeration system 100 further include a bypass module 36 and an electronic controller 50. The electronic controller 50 is coupled to the bypass module 36, while the bypass module 36 is in turn coupled to the refrigeration module 16. Thus, the electrical connections that allow the electronic controller 50 to regulate the temperature of the internal volume 14 of the container 12 are made from the electronic controller 50 to the refrigeration module 16 by way of the bypass module 36.

The electronic controller 50 such as, for example an MicroLink™ 2i controller available from Carrier Corporation of Syracuse, N.Y., USA., is electrically connected to the compressor 18, the condenser fan 28, the evaporator fan 30, and the suction modulation valve 32. The electronic controller 50 is configured to operate the refrigeration module 16 to maintain a predetermined thermal environment within the enclosed volume 14 of the container 12. The electronic controller 50 maintains the predetermined environment by selectively controlling the operation of the compressor 18, the condenser fan 28, the evaporator fan 30, and the suction modulation valve 32. For example, if increased cooling of the enclosed volume 14 is required, the electronic controller 50 provides electrical power to the compressor 16, the condenser fan 28, and the evaporator fan 30. Additionally, the electronic controller 50 adjusts the position of the suction modulation valve 32 to increase the flow of coolant supplied to the compressor 16. If less cooling of the enclosed volume 14 is required then the electronic controller 50 adjust the position of the suction modulation valve 32 to decrease the flow of coolant supplied to the compressor 16.

The bypass module 36 includes a bypass mode switch 38. The bypass mode switch 38 is a manual mechanical switch that has two positions, a normal operation position 40 and bypass operation position 42. The bypass mode switch 44 is typically maintained in the normal operation position 40 and is only moved to the bypass operation position 42 when a failure has occurred with the electronic controller 50 and the electronic controller 50 is no longer capable of controlling the operation of the refrigeration module 16 thereby jeopardizing any perishables stored within the container 12.

When the bypass mode switch 38 is in the normal operation position the electronic controller 50 regulates the operation of the compressor 18, the condenser fan 28, the evaporator fan 30 and the suction modulation valve 32.

When the bypass mode switch 38 is in the bypass operation position 42 the electrical connections between the electronic controller 50 and the refrigeration module 16 are severed, therefore the electronic controller 50 no longer controls the operation of the refrigeration module 16. Placing the bypass mode switch 38 in the bypass operation position 42 passes control of the refrigeration module 16 from the electronic controller 50 to the bypass module. The compressor 18, the condenser fan 28, the evaporator fan 30 and the suction modulation valve 32 are selectively operated by the bypass module 36 in accordance with the position of the bypass module's 36 operational mode switch 44.

The operational mode switch 44 is a multiple position switch that includes a full cool position 46 and evaporator fan only position 48. The selective operation of the compressor 18, the condenser fan 28, the evaporator fan 30 and the suction modulation valve 32 is controlled by the position of the operational mode switch 44. When the operational mode switch 44 is in the full cool position 46 the suction modulation valve 32 is opened to its maximum setting, electrical power is supplied to the compressor 18, the evaporator fan 28 and to the condenser fan 30. The compressor 18, the evaporator fan 28 and the condenser fan 30 are operated to provide maximum cooling to the enclosed volume 14. Preferably, the electrical power supplied to the evaporator fan 28 and the condenser fan 30 is sufficient to allow the evaporator fan 28 and the condenser fans 30.

Conventionally, 3-phase electrical power is used to operate the compressor 18. When 3-phase electrical power is used to operate the compressor 18 the bypass module includes a phase detection circuit 66. The phase detection circuit 66 is coupled to the 3-phase power line 68 and determines the phase rotation of the 3-phase input power. The 3-phase electrical rotation sequences that are to be detected are ABC, ACB, BAC, BCA, CBA, CAB. The phase detection circuit 66 communicates the 3-phase electrical rotation to a control logic circuit 68. The control logic circuit 68 then closes the appropriate electrical contacts (not shown) to supply electrical power having the correct electrical rotation sequence to the compressor 18.

When the operational mode switch 44 is in the fan only position 48, the compressor 18, the condenser fan 28 are turned off and the suction modulation valve 32 is driven to its fully closed position. Furthermore, electrical power is supplied to the evaporator fan 30, and the evaporator fan 30 is run at its maximum airflow setting. Thus, when the operational mode switch 44 is in the fan only position 48 the air within the enclosed volume 14 is constantly re-circulated throughout the enclosed volume 14 of the container 12.

In one embodiment of the transport refrigeration system 100 of the present invention, the transport refrigeration system 100 includes a bypass module 36 that includes an H-bridge driver circuit 52 The H-bridge driver circuit 52 controls the operation of a reversible stepper motor 54 that controls the positioning of the suction modulation valve 32. A schematic representation of the H-bridge circuit 52 is shown in FIG. 3.

In another embodiment of the transportation refrigeration system 100 of the present invention, the transportation refrigeration system 100 includes container 12, a refrigeration module 16, a bypass module 36 and an electronic controller 50.

The refrigeration module 16 includes a compressor 18 having a discharge port 20 and a suction port 22. The refrigeration module further includes a suction modulation valve 32, the suction modulation valve 32 is coupled to the suction port 22 of the compressor 18.

It will be apparent to those skilled in the art that various modifications and variations can be made to the present invention without departing from the spirit and scope of the invention. Thus, it is intended that the present invention cover the modifications and variations of this invention provided they come within the scope of the appended claims and their equivalents.

What is claimed is:

1. A refrigeration unit for regulating the temperature of an enclosed volume, the refrigeration unit comprising:

a refrigeration module, said refrigeration module including:

a compressor having a discharge port and a suction port;

a condenser heat exchanger unit operatively coupled to said discharge port;

an evaporator heat exchanger unit operatively coupled to said suction port;

a condenser fan disposed proximate to said condenser heat exchanger unit;

an evaporator fan disposed proximate to said evaporator heat exchanger unit; and a suction modulation valve coupled to said suction port;

a bypass module coupled to said refrigeration module, said bypass module including:

a bypass mode switch, said bypass mode switch having a normal operation position and bypass operation position; and an operational mode switch, said operational mode switch having a full cool position and fan only position; and an electronic controller coupled to said bypass module;

wherein when said bypass mode switch is in the normal operation position said electronic controller regulates the operation of said compressor, said condenser fan, said evaporator fan and said suction modulation valve;

wherein when said bypass mode switch is in the bypass operation position, said compressor, said condenser fan, said evaporator fan and said suction modulation valve are selectively operated by said bypass module, wherein such selective operation is controlled by the position of said operational mode switch.

2. A refrigeration unit for regulating the temperature of an enclosed volume, the refrigeration unit comprising:

a refrigeration module coupled to said container, said refrigeration module including:

a compressor having a discharge port and a suction port;

a condenser heat exchanger unit operatively coupled to said discharge port;

an evaporator heat exchanger unit operatively coupled to said suction port; and a suction modulation valve coupled to said suction port;

wherein said refrigeration module is disposed to regulate the temperature of the enclosed volume;

a bypass module coupled to said refrigeration module, said bypass module including:

a bypass mode switch, said bypass mode switch having a normal operation position and bypass operation position; and an operational mode switch, said operational mode switch having a full cool position and an evaporator only position; and an electronic controller coupled to said bypass module;

wherein when said bypass mode switch is in the normal operation position said electronic controller regulates the operation of said compressor, said condenser heat exchange unit, said evaporator heat exchanger unit and said suction modulation valve;

wherein when said bypass mode switch is in the bypass operation position, said compressor, said condenser heat exchanger unit, said evaporator heat exchanger unit and said suction modulation valve are selectively operated by said bypass module, wherein such selective operation is controlled by the position of said operational mode switch; and wherein a liquid coolant is circulated through said compressor, said condenser heat exchanger unit, said evaporator heat exchanger unit and said suction modulation valve.

3. The refrigeration unit of claim 2 wherein said condenser heat exchanger unit includes a first circulating fluid heat exchanger;

wherein said evaporator heat exchanger unit includes a second circulating fluid heat exchanger;

wherein said first circulating fluid heat exchanger transfers heat from the liquid coolant to a second circulating fluid;

wherein said second circulating fluid heat exchanger transfers heat from a third circulating fluid to the liquid coolant.

4. The refrigeration unit of claim 3 wherein said first circulating fluid heat exchanger includes a water jacket; and wherein said second circulating fluid heat exchanger includes a water jacket.

5. The refrigeration unit of claim 2 further including:

a condenser fan disposed proximate to said condenser heat exchanger unit; and an evaporator fan disposed proximate to said evaporator heat exchanger unit.

6. A transport refrigeration system comprising:

a container, said container defining an enclosed volume;

a refrigeration module coupled to said container, said refrigeration module including:

a compressor having a discharge port and a suction port;

a condenser heat exchanger unit operatively coupled to said discharge port;

an evaporator heat exchanger unit operatively coupled to said suction port;

a condenser fan disposed proximate to said condenser heat exchanger unit;

an evaporator fan disposed proximate to said evaporator heat exchanger unit; and a suction modulation valve coupled to said suction port;

wherein said refrigeration module is disposed to regulate the temperature of said enclosed volume;

a bypass module coupled to said refrigeration module, said bypass module including:

a bypass mode switch, said bypass mode switch having a normal operation position and bypass operation position; and an operational mode switch, said operational mode switch having a full cool position and fan only position; and an electronic controller coupled to said bypass module;

wherein when said bypass mode switch is in the normal operation position said electronic controller regulates the operation of said compressor, said condenser fan, said evaporator fan and said suction modulation valve;

wherein when said bypass mode switch is in the bypass operation position, said compressor, said condenser fan, said evaporator fan and said suction modulation valve are selectively operated by said bypass module, wherein such selective operation is controlled by the position of said operational mode switch.

7. The transport refrigeration system of claim 6 wherein when said bypass mode switch is in the bypass operation position and said operational mode switch is in the full cool position electrical power is supplied to said compressor, said condenser fan and said evaporator fan and said suction modulation valve is placed in the full open position.

8. The transport refrigeration system of claim 6 wherein when said bypass mode switch is in the bypass operation position and said operational mode switch is in the fan only position electrical power is supplied to said evaporator fan and said evaporator fan is operated at full capacity.

9. The transport refrigeration system of claim 6 wherein when said bypass mode switch is in the bypass operation position and said operational mode switch is in the fan only position electrical power is supplied to said evaporator fan and said evaporator fan is operated at less than full capacity.

10. The transport refrigeration system of claim 6 wherein said bypass module further includes a phase detection circuit.

11. The transport refrigeration system of claim 10 wherein said bypass module further includes an H bridge driver.

12. The transport refrigeration system of claim 11 wherein said bypass module further includes a control circuit.

13. The transport refrigeration system of claim 6 wherein said refrigeration module further includes a liquid injection valve.

14. A control module for a refrigeration system comprising:

an electronic controller for controlling the refrigeration system; and a bypass module coupled to the refrigeration system and said electronic controller, wherein said bypass module includes at least one switch whereby said electronic controller is isolated from the refrigeration system so that said electronic controller does not control said refrigeration system while operation of selected components of the refrigeration system is maintained.

15. A refrigeration unit for regulating the temperature of an enclosed volume, the refrigeration unit comprising:

a refrigeration module, said refrigeration module including:

a compressor having a discharge port and a suction port;

a condenser heat exchanger unit operatively coupled to said discharge port;

an evaporator heat exchanger unit operatively coupled to said suction port;

a condenser fan disposed proximate to said condenser heat exchanger unit;

an evaporator fan disposed proximate to said evaporator heat exchanger unit; and a suction modulation valve coupled to said suction port;

a bypass module coupled to said refrigeration module, said bypass module being switchable between a normal operation mode and bypass operation mode; and an electronic controller coupled to said bypass module;

wherein when said normal operation mode is selected said electronic controller regulates the operation of said compressor, said condenser fan, said evaporator fan and said suction modulation valve;

wherein when said bypass operation mode is selected at least one of said compressor, said condenser fan, said evaporator fan and said suction modulation valve are selectively operated by said bypass module.

* * * * *